US009260811B2

(12) United States Patent
Zelić

(10) Patent No.: US 9,260,811 B2
(45) Date of Patent: Feb. 16, 2016

(54) ANNULAR AUTO-BALANCING MECHANISM

(76) Inventor: Safedin Zelić, Sarajevo (BA)

( * ) Notice: Subject to any disclaimer, the term of this patent is extended or adjusted under 35 U.S.C. 154(b) by 356 days.

(21) Appl. No.: 13/816,728

(22) PCT Filed: Jul. 26, 2011

(86) PCT No.: PCT/BA2011/000003

§ 371 (c)(1),
(2), (4) Date: Feb. 12, 2013

(87) PCT Pub. No.: WO2012/019250

PCT Pub. Date: Feb. 16, 2012

(65) Prior Publication Data

US 2013/0133475 A1 May 30, 2013

(30) Foreign Application Priority Data

Aug. 13, 2010 (BA) ..... BAP102798A

(51) Int. Cl.

| | |
|---|---|
| ***F16F 15/32*** | (2006.01) |
| ***D06F 35/00*** | (2006.01) |
| ***D06F 37/26*** | (2006.01) |
| ***D06F 37/22*** | (2006.01) |
| ***D06F 37/24*** | (2006.01) |

(52) U.S. Cl.

CPC ..... *D06F 37/265* (2013.01); *D06F 37/225* (2013.01); *D06F 37/245* (2013.01); *Y10T 74/2109* (2015.01)

(58) Field of Classification Search

CPC ... D06F 37/225; D06F 37/265; D06F 37/345; Y10T 74/2109; F16F 15/1464; F16F 15/145

USPC ..... 74/572.2, 572.4, 574.2; 68/12.06, 23.1, 68/23.2

See application file for complete search history.

(56) References Cited

U.S. PATENT DOCUMENTS

| | | | | |
|---|---|---|---|---|
| 6,442,782 | B1 | 9/2002 | Vande Haar | |
| 8,459,148 | B2 * | 6/2013 | Kang et al. | 74/572.4 |
| 8,789,395 | B2 * | 7/2014 | Hong et al. | 68/3 R |
| 8,950,219 | B2 * | 2/2015 | Park et al. | 68/12.06 |
| 2009/0151398 | A1 * | 6/2009 | Fang et al. | 68/12.02 |
| 2012/0192362 | A1 * | 8/2012 | Lee et al. | 8/137 |
| 2014/0208809 | A1 * | 7/2014 | Kang et al. | 68/23.2 |

FOREIGN PATENT DOCUMENTS

| | | |
|---|---|---|
| EP | 0 811 717 A2 | 12/1997 |
| FR | 1.351.728 A | 12/1963 |

* cited by examiner

*Primary Examiner* — Adam D Rogers
(74) *Attorney, Agent, or Firm* — Kevin L. Klug

(57) ABSTRACT

An annular auto-balancing mechanism consisting of an annular shaped housing that is filled with fluid of specific viscosity, characterized in that its balancing weights rotate around a series of circularly set supporting axes of balancing weights, which allows for the construction of an annular shaped mechanism, which, in turn, allows the mechanism to be installed on the front side of a drum for unobstructed opening and closing of the door of a washing machine, on the one hand, and maximal utilization of the mechanism's volume, on the other hand.

3 Claims, 8 Drawing Sheets

ANNULAR AUTO-BALANCING MECHANISM

This application represents a National Stage Application of International Application No. PCT/BA2011/000003 filed on Jul. 26, 2011 and further claims priority to Bosnia And Herzegovina patent application No. BAP102798A filed on Aug. 13, 2010.

FIELD OF TECHNOLOGY TO WHICH THIS INVENTION RELATES

This invention relates to a vibration problem with washing machines caused by uneven distribution of weight around the rotating shaft during the spin cycle.

This mechanism can also be used on any rotating system which vibrates due to uneven distribution of weight around a rotating shaft.

1. Technical Field

Vibrations generated in washing machines during the spin cycle are caused by uneven distribution of the weight of laundry around a rotating shaft of the rotary drum in which the laundry is located.

Vibrations generated by this unbalanced weight are the main factor affecting the performance of washing machines in the spin cycle.

Vibrations, on the one hand, make it impossible to achieve optimal rotational speed and thereby reduce the efficiency of washing machines in the spin cycle, i.e., laundry wringing, and on the other hand, they prevent the construction of a laundry drum with optimal volume in order to increase capacity of home washing machines without changing external dimensions, which are standard.

Due to vibration, the volume of the washing machine's drum is constructed much smaller than it could have been if there had been no vibration, as it is necessary to leave an empty space between the drum and the outer walls of the machine, in order to prevent the drum from hitting the machine's walls during operation.

If there were no vibrations in a washing machine, then the volume of the laundry drum and thus the machine's washing capacity could be increased by up to 40%.

Similarly, electricity consumption for a dryer would be significantly reduced as a washing machine could run with high rpms which makes spinning much more efficient and hence, reduces the moisture content of the laundry and the amount of heat energy needed for drying of laundry.

Vibrations also account for 80% of electrical energy consumption during the spin cycle. For these reasons, the auto-balancing mechanism that could neutralize the vibrations in washing machines would have great importance.

2. The State of the Art

According to my understanding, there are two relevant types of auto-balancing mechanisms. One type of mechanism functions on the principle of metal spheres or metal cylinders placed in a fluid that rotate together with the rotating system.

The problem with this type of mechanism is that the spheres or cylinders, under the influence of centrifugal force, are pressed hard against the housing walls of these mechanisms so that the force of friction prevents the spheres from assuming the appropriate position in relation to the unbalanced weight, especially if the spheres are placed at a greater radial distance from the center, which in many cases is necessary because only in this way is it possible to increase the mechanism's balancing capacity, which is essential for balancing the washing machine.

Another type of auto-balancing mechanisms functions on the principle of two or more balancing weights set in fluid and attached to a central axis around which they can rotate freely. Due to the presence of a moment of inertia around the shaft to which they are attached, the absence of friction and a greater balancing capacity, these mechanisms are much more effective in balancing an unbalanced rotating system. However, these mechanisms were not able to find application in most standard washing machines because of the central shaft to which balancing weights are attached. In order to fully balance a washing machine's drum, both dynamically and statically, with this type of mechanism, two such mechanisms would be required, one on the front side of the drum and the other on the rear. However, due to the position of the central axis around which balancing weights rotate, it is not feasible to place this type of mechanism on the front side of the drum since the washing machine door is located in that position and it is necessary for loading and unloading the laundry from the washing machine.

In addition, one mechanism only could not balance a drum of the washing machine as it would have to be positioned in the center of the drum, which is not practically feasible as it would interfere with the laundry washing process and would significantly reduce the useful volume of the drum. It is also important to note that these mechanisms have a fairly large volume of their own so that the increase of useful volume due to the elimination of vibration would be negligible.

THE SUMMARY OF THE INVENTION

The annular auto-balancing mechanism uses all the positive characteristics of the above mentioned mechanism i.e., it uses the moment of inertia of its balancing weights for more efficient balancing but with the fundamental difference that its balancing weights are not located on a central axis, but rather, on a number of axes arranged in a circular fashion in an annular-shaped housing, so that the entire mechanism has an annular shape and can be located on the front of the drum so that it does not in any way interfere with the opening and closing of the washing machine's door.

As the balancing weights of the annular auto-balancing mechanism are located at a radial distance that corresponds to the diameter of the washing machine's drum, balancing capacity is extremely large while the volume of the mechanism is substantially reduced so that its efficiency in increasing the useful volume of the washing machine's drum is much greater than in existing mechanisms.

The annular auto-balancing mechanism allows for balancing of all types of washing machines with doors that open axially in relation to the drum of the washing machine with a minimal volume of its own, which provides the possibility for an increase in the drum's useful volume, i.e., an increase in laundry capacity, which existing mechanisms cannot provide.

DETAILED DESCRIPTION OF THE INVENTION

Figure 1:
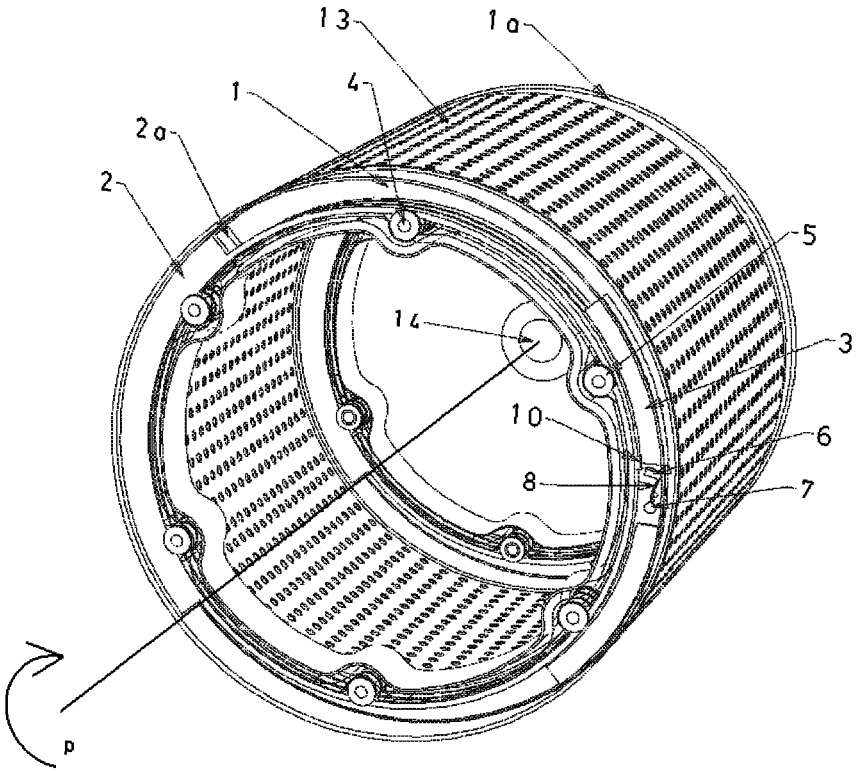
FIG. 1: The annular auto-balancing mechanism mounted on a washing machine's rotating drum. The housing of the mechanism is shown transparently for easier viewing of the balancing weights layout.

FIG. 1 shows a rotary drum 13 of a washing machine with two identical annular auto-balancing mechanisms mounted on its front and rear end which are located in the housing 1 in the front and the housing 1*a* in the rear. The drum 13 rotates around the drum drive axis 14, i.e., around the horizontal axis p.

Figure 2:
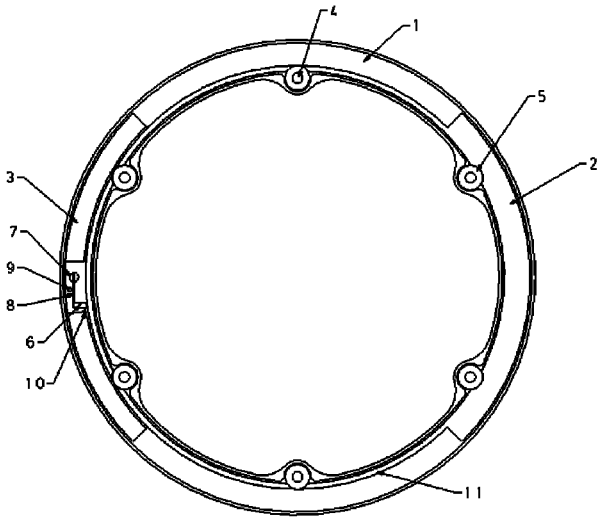
FIG. 2: Front view of the annular auto-balancing mechanism.

The annular auto-balancing mechanism, FIG. 2, consists of a housing 1 filled with fluid of a specific viscosity. The housing 1 houses the bearing axes 4 of the balancing weights 2, 2*a*, 3, 17, 18, 19 which are arranged in a circular fashion and have rotary bearings 5 located on them, supporting rings 11, 11*a*, 12 of the balancing weights 2, 2*a*, 3 respectively are located on the rotary bearings 5 and three balancing weights 2, 2*a*, 3 are located on these supporting rings 11, 11*a*, 12. The balancing weights 2, 2*a*, 3 are constructed in such a way that the balancing weight 2 and the balancing weight 2*a* are equal in weight and weigh half as much as the balancing weight 3, and they are positioned on the front and rear side of the balancing weight 3. This way a common center of mass for weights 2 and 2*a* is located in the same plane as the center of mass of the balancing weight 3.

An auxiliary mechanism for controlled engaging of balancing weights 2, 2*a*, 3 is located on the balancing weight 3 and it consists of the tooth 6, the metal spring girder 7, the metal spring 8, the metal spring limiter 9, and the tooth limiter 10, which is located on the supporting rings 11, 11*a*, of the balancing weights 2 and 2*a* respectively.

The auxiliary mechanism for the engaging of the balancing weights 2, 2*a*, 3 in the balancing process allows stable operation of the mechanism at low rpms, when, under the influence of gravity, centrifugal and inertia forces, the balancing weights 2, 2*a*, 3 are unable to assume a suitable position in relation to the unbalanced weight 15, hence the effect of balancing at a low number of revolutions, i.e., at the beginning of the spin cycle with speeds up to 300 rpm is negligible or even worsened due to chaotic motion of the balancing weights 2, 2*a*, 3.

Figure 3:
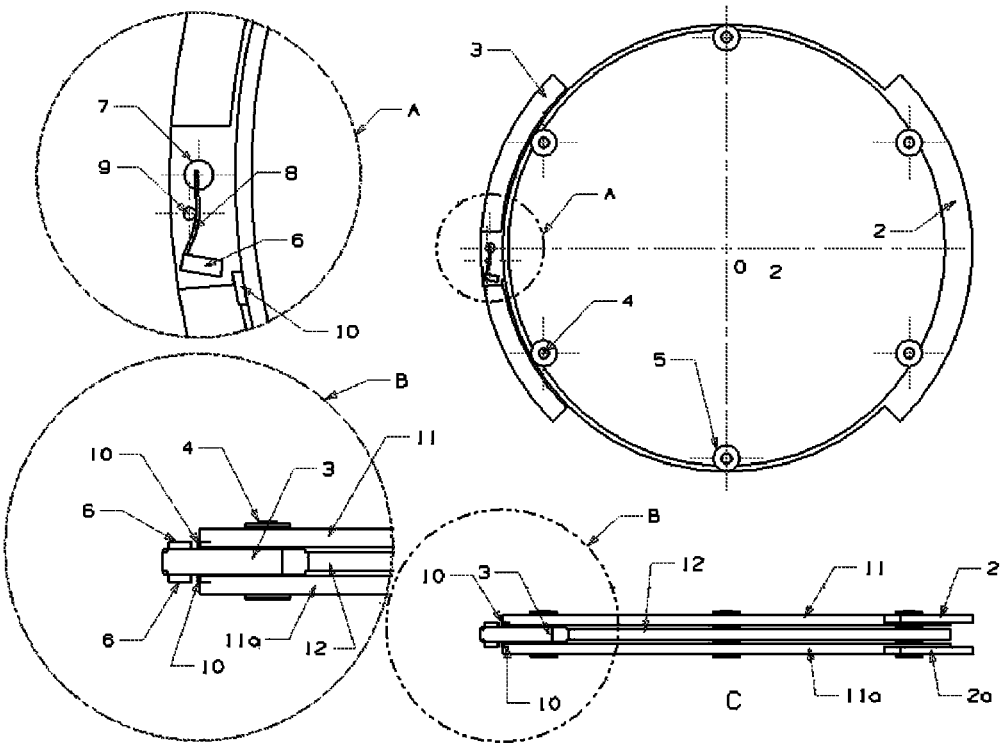
FIG. 3: Balancing weights layout view with a detailed view of the auxiliary engaging mechanism.
Figure 6:
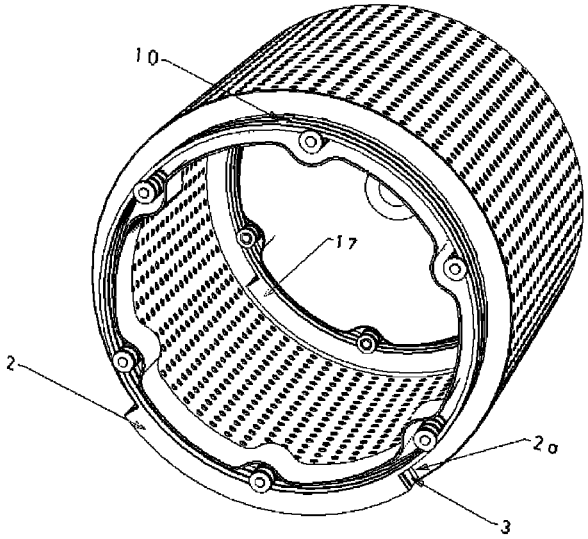
FIG. 6: Three-dimensional view of a rotating drum with the balancing weights located in idle position. The housing of the mechanism is not shown for easier viewing of the balancing weights layout.

The auxiliary engaging mechanism operates in such a way that prior to the start of rotation, the balancing weights 2 and 2*a* and the balancing weight 3 are positioned as shown in FIG. 6. At the very beginning of the rotation, the balancing weights 2 and 2*a*, under the influence of the viscous forces of the fluid, begin moving faster than the balancing weight 3 due to the fact that they weigh half as much; this causes the tooth limiters 10, located on the supporting rings 11, 11*a*, of the balancing weights 2 and 2*a* respectively to catch up with the tooth 6, which is located on the metal spring 8, which is, in turn, located on the balancing weight 3. Further the movement of the balancing weights 2 and 2*a* relative to the balancing weight 3 is prevented by the contact of the tooth 6 and tooth limiters 10, so that now, these weights 2, 2*a*, 3 start moving with the same speed at a relative position of 180 degrees to each other. In this position, the balancing weights 2, 2*a*, 3 cannot generate any chaotic motion on the one hand, and on the other hand, the relative position of 180 degrees is ideal for the engaging of the balancing weights 2, 2*a*, 3 in the process of balancing. This engagement takes place at a speed of 300 rpm when the intensity of the centrifugal force acting on the mass of the auxiliary engaging mechanism tooth 6, FIG. 3, is sufficiently greater than the elastic force of the metal spring 8, so that it can raise the tooth 6 and hence, allow the tooth limiter 10 and the tooth 6 to go past each other and move relative to each other in a 360 degrees range, which is a prerequisite for the balancing weights 2, 2*a*, 3 to engage in the balancing process.

Figure 4:
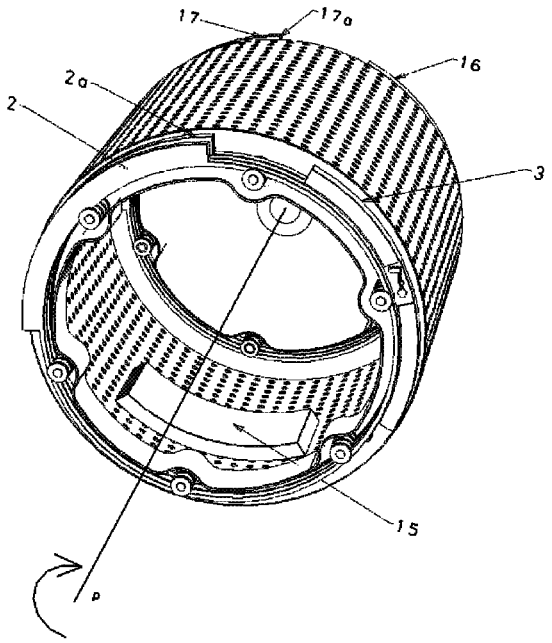
FIG. 4: Three-dimensional view of a rotating drum with the balancing weights located in the balancing position and the unbalanced weight located in the center of the drum. The housing of the mechanism is not shown for easier viewing of the balancing weights layout.
Figure 5:
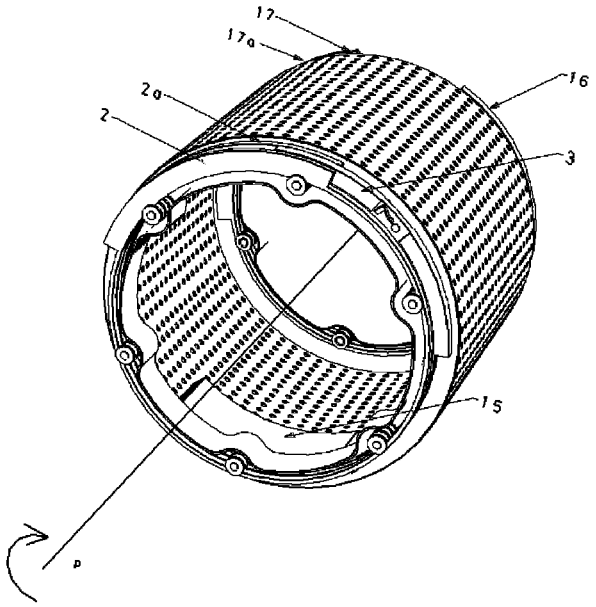
FIG. 5: Three-dimensional view of a rotating drum with the balancing weights located in the balancing position and the unbalanced weight located on the front side of the drum. The housing of the mechanism is not shown for easier viewing of the balancing weights layout.

After the balancing weights 2, 2*a*, 3 are allowed to move freely relative to each other, the balancing weights 2 and 2*a*, on the one side, and the balancing weight 3, on the other, under the influence of their respective moments of inertia, begin to get closer to each other on the side opposite of the unbalanced weight 15 location, up to the point when equilibrium between balancing and unbalanced weights 15 is established, FIG. 4. If the unbalanced weight 15 assumes a different axial position, as in FIG. 5, where the unbalanced weight 15 is moved toward the front of the drum 13, then the balancing weights 2, 2*a*, 3 in housing 1 make a greater deviation from the equilibrium position i.e., they move closer together than the balancing weights 16, 16*a*, 17 in the housing 1*a*. If the unbalanced weight 15 had been positioned closer to the back, then the deviation of the balancing weights 16, 16*a*, 17 in the housing 1*a* would have been greater.

Figure 7:
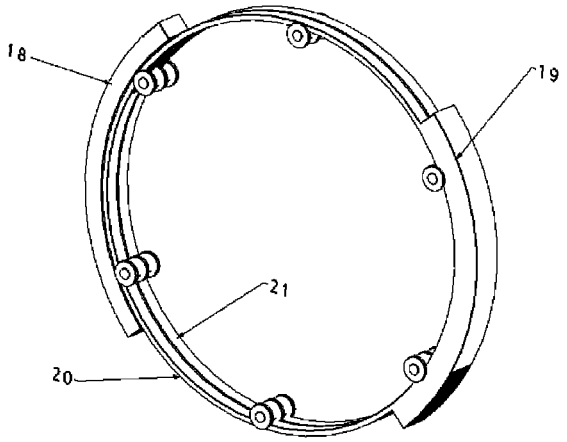
FIG. 7: Three-dimensional view of the mechanism with two balancing weights without an auxiliary engaging mechanism.
Figure 8:
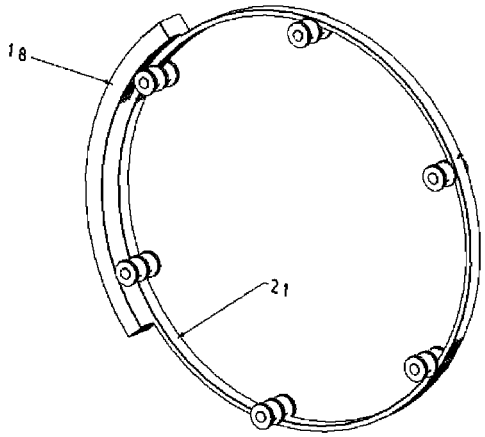
FIG. 8: Three-dimensional view of a single balancing weight without an auxiliary engaging mechanism.

If in some applications of this mechanism, controlled engagement of the balancing weights 2, 2*a*, 3 at a lower number of revolutions is not necessary, then the annular auto-balancing mechanism can be constructed with two weights 18, 19, as shown in FIGS. 7 and 8. This design also meets the requirement that the center of mass of the balancing weights 18 and 19, supported by supporting rings 21 and 20 respectively, is located in the same plane, otherwise the mechanism would generate vibrations of its own.

The invention claimed is:

1. An annular auto-balancing mechanism comprising:

an annular housing filled with a viscous fluid, and three balancing weights, each of said balancing weights rotating around one of a series of supporting bearing axes circularly set in said housing, wherein said three balancing weights are constructed in such a way that a first of said balancing weights and a second of said balancing weights each weigh half as much as a third of said balancing weights, said third of said balancing weights being located between said first and said second of said balancing weights, so that the common center of mass of said first and second of said balancing weights is located in the same plane as the center of mass of said third of said balancing weights.

2. The annular auto-balancing mechanism in of claim 1, further comprising:

an auxiliary mechanism consisting of a tooth and a metal spring positioned on said third of said balancing weights and a tooth limiter mounted on supporting rings, said auxiliary mechanism setting said balancing weights in a relative position of 180 degrees to each other at a spin cycle beginning speed of rotation and enabling unobstructed free movement of said balancing weights relative to each other in any direction in a 360 degree range at a speed of rotation higher than said spin cycle beginning speed of rotation.

3. The annular auto-balancing mechanism of claim 2, characterized in that a release of said balancing weights from said position of 180 degrees is obtained by centrifugal force acting on a mass of said tooth, which becomes greater than a tension force of said metal spring, and raises said tooth above said tooth limiter, which allows said balancing weights to assume a position in relation to an unbalanced weight and establish a state of equilibrium.

* * * * *